US006367199B2

(12) United States Patent
Sedlak et al.

(10) Patent No.: US 6,367,199 B2
(45) Date of Patent: Apr. 9, 2002

(54) VEHICLE LIFTGATE POWER OPERATING SYSTEM

(75) Inventors: David A. Sedlak, Clarkston; John R. Rice, Clinton Township; Lloyd Walker Rogers, Jr., Shelby Township; Ronald James Wilde, St. Clair Shores, all of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/756,416

(22) Filed: Jan. 8, 2001

Related U.S. Application Data

(60) Provisional application No. 60/184,194, filed on Feb. 22, 2000.

(51) Int. Cl.[7] ..... E05F 11/24

(52) U.S. Cl. ..... 49/340; 296/56

(58) Field of Search ..... 49/339, 340, 341, 49/342; 296/56, 146.8, 202

(56) References Cited

U.S. PATENT DOCUMENTS 4,903,435 A 2/1990 Bittmann et al.
5,588,258 A 12/1996 Wright et al.
6,055,775 A 5/2000 Dering et al.
6,055,776 A * 5/2000 Dettling et al. ..... 49/341
6,092,337 A 7/2000 Johnson et al.
6,135,536 A * 10/2000 Ciavaglia et al. ..... 296/146.4
6,137,249 A * 10/2000 Butler et al. ..... 318/266
6,142,551 A * 11/2000 Ciavaglia et al. ..... 49/340
6,202,350 B1 * 3/2001 Montgomery et al. ..... 49/341
6,234,563 B1 * 5/2001 Bascou ..... 296/146.8
6,270,147 B1 * 8/2001 Butler et al. ..... 296/146.4

FOREIGN PATENT DOCUMENTS

JP 403279578 * 12/1991 ..... 49/340

* cited by examiner

*Primary Examiner*—Jerry Redman
(74) *Attorney, Agent, or Firm*—Kathryn A. Marra

(57) ABSTRACT

A power operating system for opening and closing a vehicle liftgate has a pair of drive units supported on the vehicle pillars at the sides of the liftgate opening. Each drive unit includes a vertically oriented channel and a rack bar that moves in the channel. A link is universally attached to the rack bar at one end and universally attached to the liftgate at the opposite end. The rack bar is raised and lowered by a power unit that has a motor driven pinion gear that meshes with the rack bar. Raising and lowering the rack bar opens and closes the liftgate via the link.

10 Claims, 4 Drawing Sheets

VEHICLE LIFTGATE POWER OPERATING SYSTEM

This application claims the benefit of U.S. provisional application No. 60/184,194 filed on Feb. 22, 2000, the disclosure of which are incorporated herein by reference in their entirety as if set forth at length.

TECHNICAL FIELD

This invention relates to a power operating system for a vehicle liftgate that is pivotally attached to a vehicle roof for pivotal movement about a generally horizontal hinge axis and more particularly to a power operating system that moves a lifigate from a fully closed position to a fully open position and from an open position to a fully closed position.

BACKGROUND OF THE INVENTION

Sport utility vehicles, vans and the like that are equipped with liftgates that are hinged at the top about a generally horizontal hinge axis are used by large numbers of people today. Some of these liftgates are large and heavy. Their size and weight make some liftgates difficult to open and close. Some of the liftgates are also a great distance above the ground when they are fully opened. Their height above the ground makes them very difficult for some people to close. For these and other reasons many people would like to have a power operating system for opening and closing the liftgate.

A number of different liftgate openers have been tried in recent years. Some of these liftgate openers have a single cable that opens and closes a liftgate in connection with a counterbalance system, such as gas cylinders. Liftgates with a single cable opener and closer are generally trunk lids that are lightweight and have a relatively small range of movement.

Gas cylinder output varies with temperature. This complicates power liftgate systems that rely on gas cylinders to open the liftgate. The gas cylinder or cylinders must be strong enough to open the liftgate on the coldest date (−40° C.). This results in gas cylinders that increase closing resistance substantially on the hottest day (80° C.). Therefore a very large electric motor must be used to close the liftgate.

Liftgates that have two or more gas cylinders for a counter balance system are common. These gas cylinders generally occupy a position in which their axis is substantially parallel to the liftgate so that the gas cylinders are hidden when the liftgate is closed. In this closed position the moment arm of the gas cylinders is quite small. With such systems the lift gate may move about one-third of their total travel range before the gas cylinders exert sufficient force to open a liftgate further without the application of an independent lifting force. There are even some systems in which the gas cylinders pass over center and bias a liftgate toward a closed position when the liftgate is closed. With these self-closing systems a liftgate may need to be more than one-third open before the gas cylinders will open the liftgate further.

U.S. Pat. No. 4,903,435 granted to Werner Bittmann et al Feb. 27, 1990 discloses a device for motorized opening and closing of pivotal body panels of motor vehicles comprising an actuation rod that is pivotally attached to the pivotal body panel at one end and to a slide block at the opposite end. The slide block is moved in an inclined linear track by a control cable that is moved in a closed loop by a cable drum driven by an electric motor. The Bittnann '435 device is bulky and cumbersome and relies on gravity to fully close the pivotal body panel.

U.S. Pat. 5,588,258 granted to Kevin Wright et al Dec. 31, 1996 discloses a power operator for a pivotal closure element comprising two gas charged struts and an extendible strut adapted for extension by a cable drive. The Wright '258 power operator opens and closes the pivotal closure element fully. However, the extendible strut and cable drive are complicated and expensive and require substantial vertical space.

U.S. Pat. No. 6,055,775 granted to Timothy Dering et al May 2, 2000 discloses a liftgate self-closing device comprising a pneumatic actuator that is pivotally attached to liftgate at one end and to a tape at the opposite end. The tape is a generally elongated belt member having a rack formed on an underside. The rack is disposed in a track and driven by a pinion gear attached to the output shaft of an electric motor. Alternatively, the tape could be an endless member. In either event, the liftgate is opened manually until an over center condition is achieved in the pneumatic actuator which then opens the liftgate automatically. The liftgate is closed by energizing the motor to drive the tape and pneumatic actuator downwardly until the liftgate is closed by gravity. The Dering device requires manual operation to open the liftgate and relies on gravity to fully close the liftgate.

U.S. Pat. No. 6,092,337 granted to Joseph Michael Johnson et at Jul. 25, 2000 discloses a vehicle liftgate power operating system having two drive units in which a segmented sector rides in a track with an end sector that is attached to the liftgate. The segmented sector is driven by a pinion gear attached to the output shaft of an electric motor. This power operating system opens and closes the liftgate fully and is satisfactory for its intended purpose. However, the drive units reduce the head room in the cargo space which may be objectionable to some users.

SUMMARY OF THE INVENTION

The object of the invention is to provide an improved vehicle liftgate power operating system.

A feature of the invention is that the vehicle liftgate power operating system can move the liftgate from a closed position to a fully opened position as well as from an open position to a fully closed position.

Another feature of the invention is that the liftgate power operating system does not diminish head room in the cargo area.

Another feature of the invention is that power operating system is compact durable and economical to manufacture.

Still another feature of the invention is that the drive unit of the liftgate power operating system has fewer parts and is less complicated than other power operating systems.

Yet another feature of the invention is that the liftgate power operating system is vertically oriented and associated with the D-pillar to minimize intrusion into the cargo area of the vehicle and into the unobstructed load width at the liftgate opening.

Still yet another feature of the invention is that the power operating system can be used in conjunction with a counterbalance system for a manual operating system without any modification in the counterbalance system.

These and other objects, features and advantages of the invention will become more apparent from the following description of a preferred embodiment taken in conjunction with the accompanying drawing.

BRIEF DESCRIPTION OF THE DRAWINGS

The presently preferred embodiment of the invention is disclosed in the following description and in the accompanying drawings, wherein.

DETAILED DESCRIPTION OF THE PREFERRED EMBODIMENT

Figure 1:
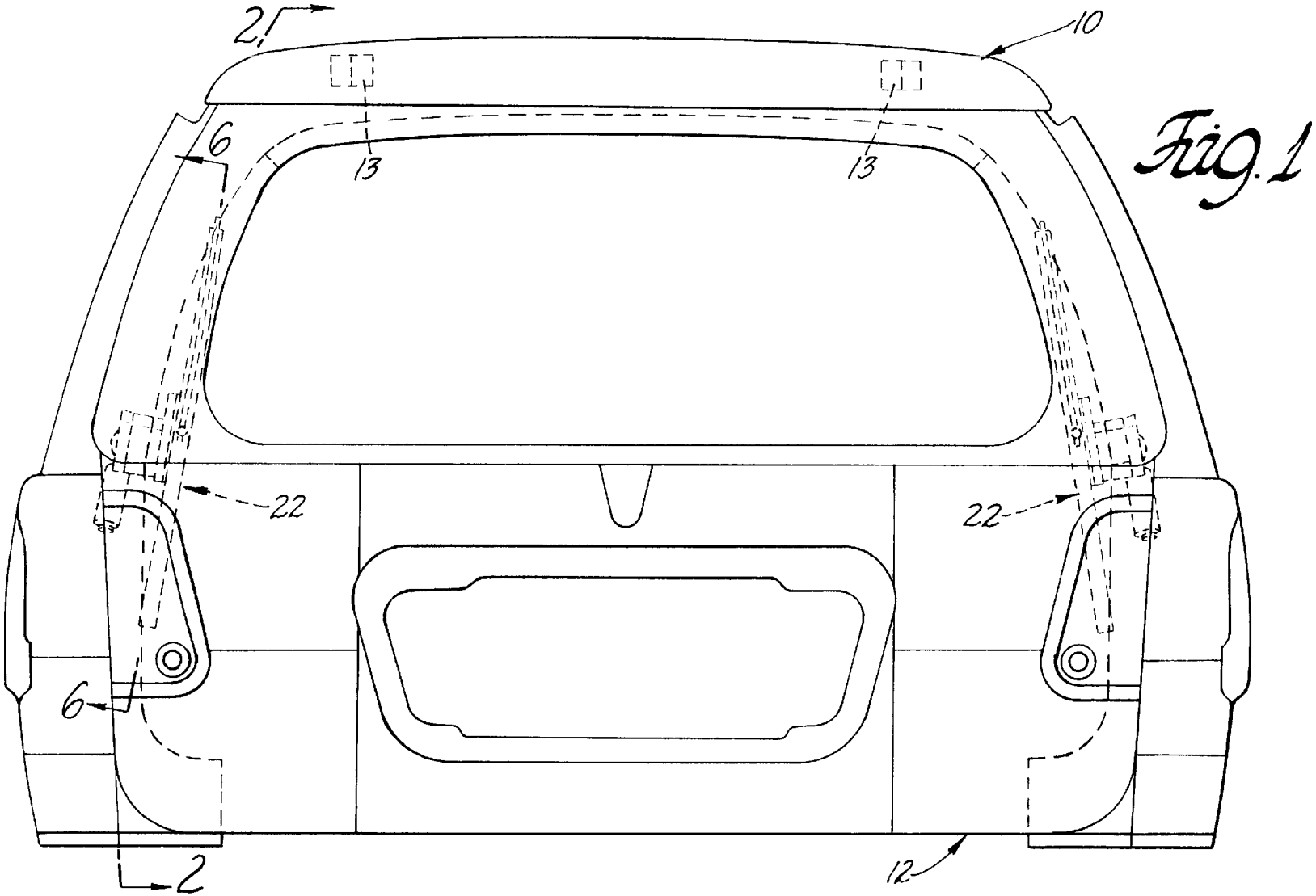
FIG. 1 is a rear view of a sport utility vehicle equipped with a liftgate power operating system of the invention showing the liftgate in a closed position.
Figure 2:
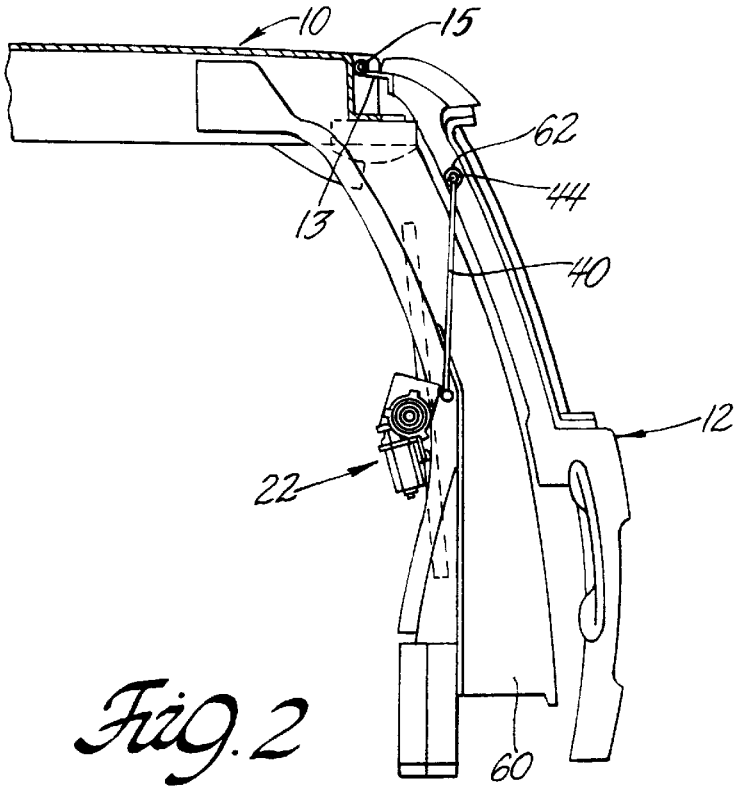
FIG. 2 is a sectional view taken substantially along the line 2—2 of FIG. 1 looking in the direction of the arrows.
Figure 3:
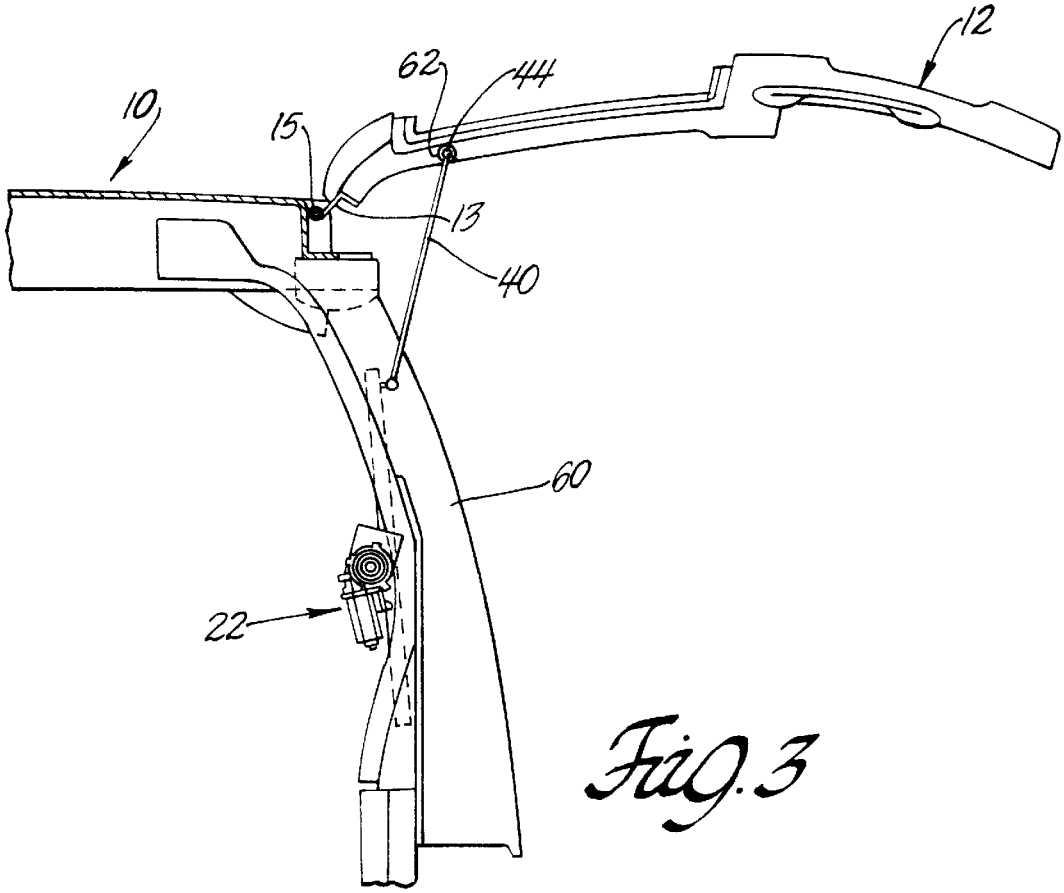
FIG. 3 is a sectional view of the sport utility vehicle similar to FIG. 2 but showing the liftgate in an open position.
Figure 4:
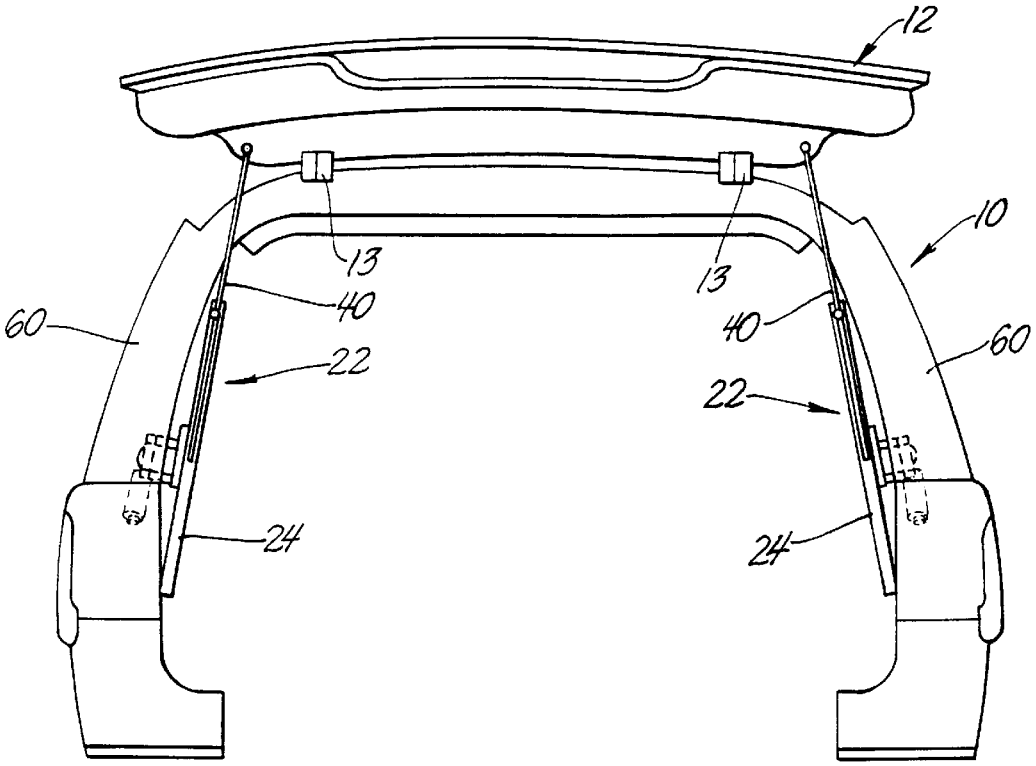
FIG. 4 is a rear view of the sport utility vehicle of FIG. 1 but showing the liftgate in an open position.

Sport utility vehicle 10 has a liftgate 12 that is attached to the aft end of the vehicle roof by two hinge assemblies 13 so that liftgate 12 pivots about a generally horizontal hinge 15 axis from a closed position shown in FIGS. 1 and 2 to a raised open position shown in FIGS. 3 and 4. Hinge axis 15 is generally substantially horizontal and liftgate 12 is generally permitted to pivot about 90° about the pivot axis between a generally horizontal open position and a generally vertical closed position. However, the range of movement can be varied substantially from one model of vehicle to another.

Figure 5:
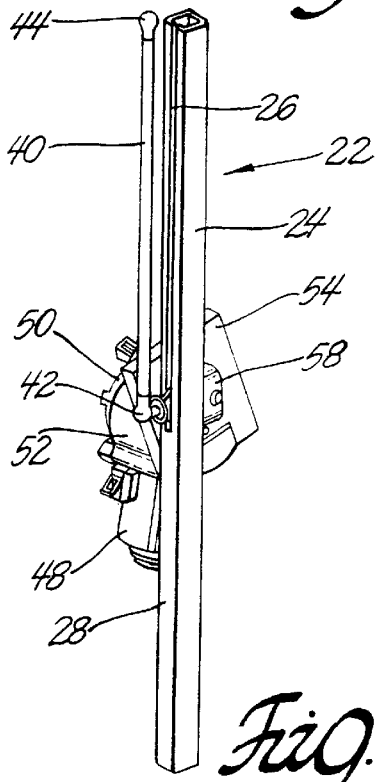
FIG. 5 is an isometric view of the one of the lift mechanisms shown in FIGS. 1–4.

Liftgate 12 is opened and closed by a power operating system that includes at least one and preferably two identical lift mechanisms 22 that are installed in the aft end of the vehicle at the D-pillars that define the width of the rear opening to the cargo area that is closed by liftgate 12. One typical lift mechanism 22 is shown in detail in FIGS. 5, 6 and 7.

Figure 6:
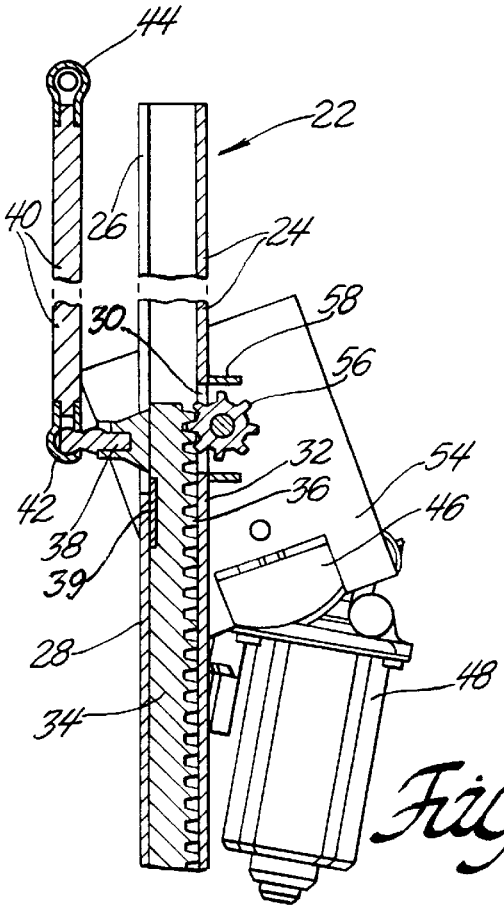
FIG. 6 is a vertical section of the lift mechanism shown in FIG. 5.
Figure 7:
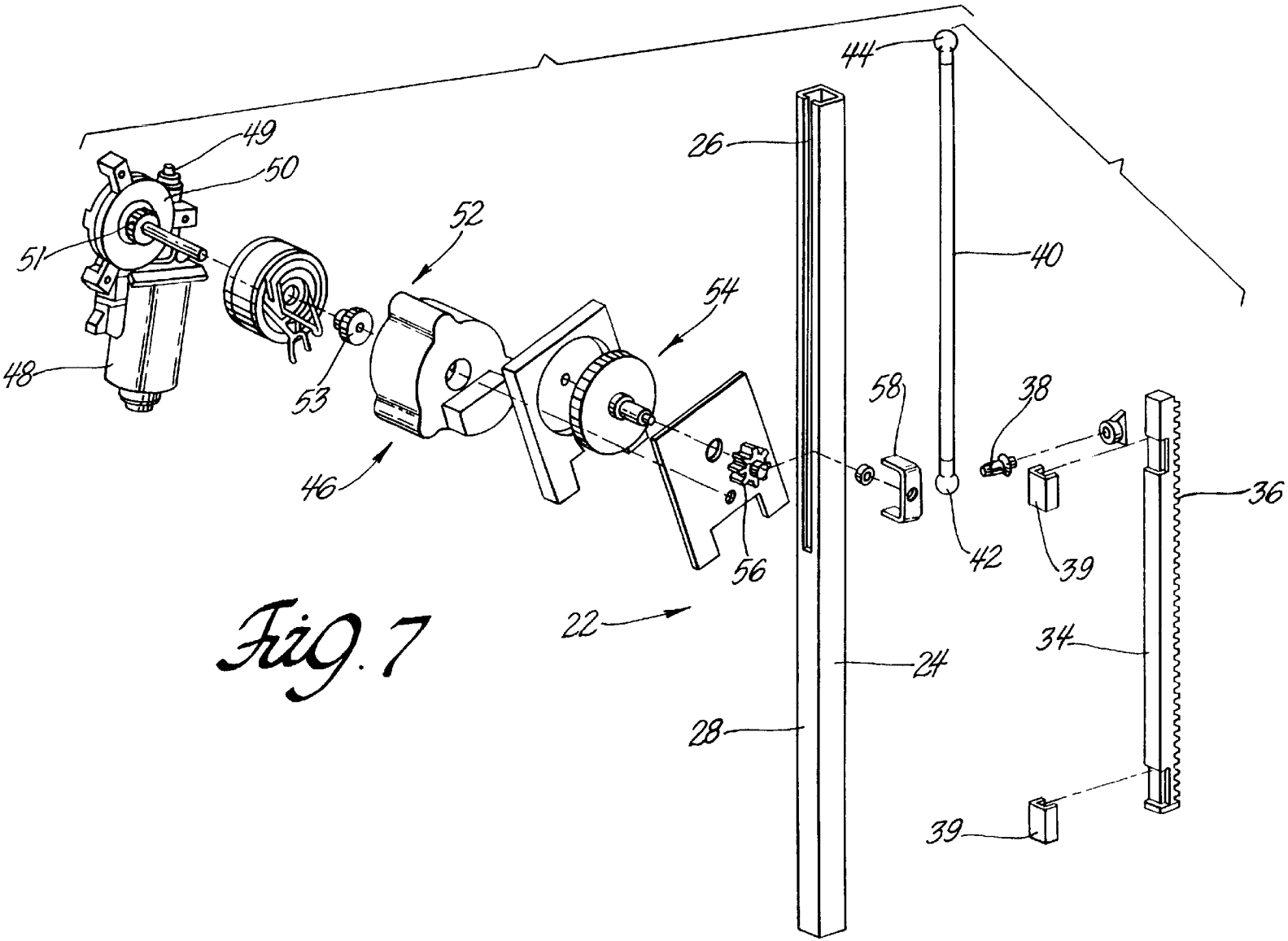
FIG. 7 is an exploded view of the lift mechanism shown in FIG. 5.

Lift mechanism 22 comprises an annular, square shaped linear channel 24 having an longitudinal slot 26 in an upper portion of side wall 28 of the annular channel. Channel 24 has a window 30 in an opposite side wall 32 that is aligned with the bottom portion of slot 26 as best shown in FIG. 6. A rack bar 34 is disposed in channel 24 for linear movement in the channel 24 which serves as a guide or track for rack bar 34. Rack bar 34 has teeth 36 on one side facing side wall 32 so that window 30 provides access to teeth 36. A ball stud 38 is attached to the opposite side of rack bar 34 at the upper end so that ball stud 38 extends through slot 26. Rack bar 34 preferably has a U-shaped shoe 39 of low friction material adjacent each end to facilitate sliding movement of rack bar 34 in channel 24.

Lift mechanism 22 includes a link 40 that has a ball socket 42 at the lower end and a ball socket 44 at the upper end. Ball stud 38 is disposed in ball socket 42 so that the lower end of link 40 is universally attached to rack bar 34. The opening of ball socket 44 is perpendicular to the opening of ball socket 42. Ball socket 44 is used to attach the upper end of link 40 to liftgate 12 for universal movement relative to the liftgate 12 by means of a ball stud that is generally perpendicular to ball stud 38 as further explained below.

Lift mechanism 22 includes a power unit 46 for raising and lowering rack bar 34 in channel 24. Power unit 46 comprises an electric motor 48, a first gear set 50, an electromagnetic clutch 52 and a second gear set 54, that includes an output pinion gear 56. Electric motor 48 has a worm gear output 49 that drives gear set 50 which changes the drive axis 90° and includes an output pinion gear 51. Output pinion gear 51 drives the input side of electromagnetic clutch 52; the output side of which drives gear 53. Gear 53 drives gear set 54 which as indicated above has an output pinion gear 56. Power unit 46 is attached to a side wall of channel 24 so that pinion gear 56 projects into window 30 and meshes with teeth 36 of rack bar 34 as best shown in FIG. 6. The housing cover of gear set 54 preferably includes a combined guard and bearing support 58 for pinion gear 56.

Lift mechanism 22 is installed in vehicle 10 with channel 24 fixed to the vehicle at the D-pillar 60 by suitable brackets, fasteners, weldments or the like (not shown). The channel 24 is supported in a generally vertical orientation and preferably as vertical as possible in both the longitudinal direction and the transverse direction of the vehicle. The vertical deviation will depend on the shape for the particular vehicle model. For instance, in the illustrated vehicle, the channel 25 tilts forward in the longitudinal direction about 10 degrees as best shown n FIGS. 2 and 3. On the other hand, channel 24 tilts inward in the lateral direction about 10 degrees as best shown in FIGS. 1 and 4.

Lift mechanism 22 is also installed so that the ball stud 38 faces rearwardly on an axis that is substantially parallel to the longitudinal axis of the vehicle. Teeth 36 are on the opposite side of the square rack bar 34 and face forwardly. Power unit 46 is attached to the outboard side of channel 24.

Link 40 is universally attached to the rearward facing ball stud 38 at the lower end by ball socket 42 which is open in the longitudinal direction. The upper end of link 40 is universally attached to a ball stud 62 at a side edge of liftgate 12 by upper ball socket 44 which is open in the transverse direction. Ball stud 62 is attached to a side edge of the lift gate 12 so that the axis of ball stud 62 is spaced from hinge axis 15 and essentially perpendicular to the longitudinal axis of the vehicle or a longitudinal axis parallel to it. Thus link 40 is free to pivot in any direction with respect to rack bar 34 and with respect to liftgate 12. This freedom of movement reduces side loads on ball stud 38 that tend to twist rack bar 34 so that the substantially twist-free rack bar 34 slides in channel 24 smoothly and does not bind with the channel 24 or pinion gear 56.

The power operating system further includes a conventional power source such as the vehicle battery (not shown) and a suitable motor control for energizing and shutting off the reversible electric motor 48. Motor controls are well known to those skilled in the art and thus need not be described in detail.

The power operating system operates as follows. Assuming that the liftgate 12 is closed as shown in FIGS. 1 and 2, electric motor 48 and electromagnetic clutch 52 are energized to open liftgate 12. When energized, electric motor 48 rotates pinion gear 51 clockwise via gear set 50. Pinion gear 51 in turn rotates output gear 53 clockwise via the engaged electromagnetic clutch 52. Gear 53 drives gear 56 clockwise via gear set 54 until rack bar 34 is driven from the retracted position shown in FIGS. 1 and 2 to the raised position shown in FIGS. 3 and 4. This raises liftgate 12 from the closed position shown in FIGS. 1 and 2 to the raised open position shown in FIGS. 3 and 4 via link 40. When the liftgate 12 is fully opened, a limit switch or the like is actuated to shut off electric motor 48 and electromagnetic clutch 52. Liftgate 12 is closed by reversing electric motor 48 so that gear 56 drives rack bar 34 back to the retracted position shown in FIGS. 1 and 2.

The liftgate 12 can be moved manually in the event of a power failure easily because the deenergized clutch 52 allows the clutch output gear 53 to free wheel with respect to electric motor 48 and gear set 50.

The power operating system can be designed to work alone or in conjunction with gas cylinders which are well known in the art with the primary adjustment being the size of the electric motor 48.

The power operating system described above preferably includes two identical drive units 22 for balanced operation and reduced manufacturing costs. However, the drive units need not be identical and in some instances, a single drive unit may be sufficient.

While the preferred embodiment has the ball stud 38 facing rearwardly to minimize twist on the rack bar 34, the ball stud 38 may face in any direction. In one aspect, it is an advantage to face the ball stud 38 inwardly. This allows the lift mechanism 22 to be moved outwardly to save space. Moreover, the preferred embodiment also includes an electromagnetic clutch. However, it is possible to eliminate the electromagnetic clutch and use a back driveable electric motor to lower the cost. In other words, many modifications and variations of the present invention in light of the above teachings may be made. It is, therefore, to be understood that, within the scope of the appended claims, the invention may be practiced otherwise than as specifically described.

We claim:

1. A power operating system for opening and closing a vehicle liftgate that is pivotally attache to an aft end of a vehicle roof for pivotal movement between an open position and a closed position about a generally horizontal hinge axis comprising:

an annular channel having a longitudinal slot in a side wall of the annular channel and a window in the side wall of the annular channel disposed opposite the longitudinal slot, a rack bar disposed in the channel for movement in the channel, the rack bar having a stud that extends through the longitudinal slot in the side wall of the annular channel, the rack bar having teeth facing the window in the side wall of the annular channel, a link having an end that is universally connected to the stud, the link having an opposite end that is universally attached to the liftgate at a location spaced from the hinge axis, and a power unit having an output pinion gear meshing with teeth of the rack bar for moving the rack bar in the annular channel between a first position holding the vehicle liftgate in the open position and a second position holding the vehicle liftgate in the closed position.

2. The power operating system as defined in claim 1 wherein the power unit is secured to the annular channel and comprises an electric motor that drives the output pinion gear via an electromagnetic clutch.

3. The power operating system as defined in claim 1 wherein the annular channel is disposed in a vehicle in a vertical orientation.

4. A vehicle having a vehicle liftgate that is pivotally attached to an aft end of a vehicle roof for pivotal movement between an open position and a closed position about a generally horizontal hinge axis and a power operating system for opening and closing the vehicle liftgate, the power operating system comprising:

a rectangular channel fixed to the vehicle at a pillar of the vehicle in a vertical orientation, the rectangular channel having a longitudinal slot in a side wall of the rectangular channel and a window in an opposite side wall of the rectangular channel, a rectangular rack bar disposed in the channel for movement in the channel, the rack bat having a stud that extends through the longitudinal slot in the side wall of the channel, the rack bar having teeth facing the window in the opposite side wall of the channel, a link having an end that is universally connected to the stud, the link Laving an opposite end that is universally attached to the liftgate at a location spaced from the hinge axis, and a power plant unit having an output pinion gear meshing with teeth of the rack bar for moving the rack bar in the channel between a first position holding the vehicle liftgate in the open position and a second position holding the vehicle liftgate in the closed position.

5. The power operating system as defined in claim 4 wherein the power unit is secured to an outboard side wall of the channel and comprises an electric motor that drives the output gear via an electromagnetic clutch.

6. Vehicle having a vehicle liftgate that is pivotally attached to an aft end of a vehicle roof for pivotal movement between an open position and a closed position about a generally horizontal hinge axis and a power operating system for opening and closing the vehicle liftgate, he power operating system comprising:

a rectangular channel fixed to the vehicle at a rear pillar of the vehicle in a vertical orientation, the rectangular channel having a longitudinal slot in a side wall of the rectangular channel that faces rearwardly toward the liftgate, the rectangular channel having a window in an opposite side wall of the rectangular channel that faces forwardly away from the liftgate, a rectangular rack bar disposed in the channel for movement in the channel, the rack bar having a stud that extends through the longitudinal slot in the side wall of the channel, the rack having teeth facing the window in the opposite side wall of the channel, a link having a first socket at one end that is universally connected to the stud, the link having a second socket at an opposite end that is universally attached to a second stud attached to the liftgate at a location spaced from the hinge axis, and a power unit having an output pinion gear that projects into the window of the channel and meshes with the teeth of the rack bar for moving the rack bar in the rectangular channel between a first position holding the vehicle liftgate in the open position and a second position holding the vehicle liftgate in the closed position.

7. The power operating system as defined in claim 6 wherein the power unit is secured to an outboard side wall of the rectangular channel and comprises an electric motor that drives the output gear via an electromagnetic clutch.

8. The power operating system as defined in claim 6 wherein the first socket is open in a longitudinal direction of the vehicle and the second socket is open in a transverse direct ion of the vehicle.

9. The power operating system as defined in claim 6 wherein the rack bar has a U-shaped shoe of low friction material at each end.

10. The power operating system as defined in claim 6 wherein the rectangular channel is linear.

* * * * *